US009004889B2

(12) United States Patent
Uozumi et al.

(10) Patent No.: US 9,004,889 B2
(45) Date of Patent: Apr. 14, 2015

(54) INTERNAL GEAR PUMP

(71) Applicant: Sumitomo Electric Sintered Alloy, Ltd., Takahashi (JP)

(72) Inventors: Masato Uozumi, Itami (JP); Toshiyuki Kosuge, Itami (JP)

(73) Assignee: Sumitomo Electric Sintered Alloy Ltd., Okayama (JP)

( * ) Notice: Subject to any disclaimer, the term of this patent is extended or adjusted under 35 U.S.C. 154(b) by 12 days.

(21) Appl. No.: 14/119,412

(22) PCT Filed: Oct. 16, 2012

(86) PCT No.: PCT/JP2012/076657

§ 371 (c)(1),
(2) Date: Nov. 21, 2013

(87) PCT Pub. No.: WO2013/058223

PCT Pub. Date: Apr. 25, 2013

(65) Prior Publication Data

US 2014/0199198 A1 Jul. 17, 2014

(30) Foreign Application Priority Data

Oct. 21, 2011 (JP) ..... 2011-231603

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/10*** | (2006.01) |
| ***F01C 1/08*** | (2006.01) |
| ***F04C 2/08*** | (2006.01) |

(52) U.S. Cl.

CPC ..... *F04C 2/103* (2013.01); *F01C 1/084* (2013.01); *F04C 2/084* (2013.01); *F04C 2/102* (2013.01)

(58) Field of Classification Search

CPC ..... F04C 2/084; F04C 2/102; F04C 18/08; F04C 18/082; F04C 18/084; F04C 15/0049; F01C 1/084; F01C 1/103

USPC ..... 418/150, 166, 171

See application file for complete search history.

(56) References Cited

U.S. PATENT DOCUMENTS

| | | | | | |
|---|---|---|---|---|---|
| 2,965,039 | A | * | 12/1960 | Morita | 418/150 |
| 4,504,202 | A | * | 3/1985 | Saegusa | 418/150 |
| 4,518,332 | A | * | 5/1985 | Saegusa | 418/150 |
| 4,657,492 | A | * | 4/1987 | Saegusa | 418/150 |
| 5,762,484 | A | * | 6/1998 | Whitham | 418/150 |

FOREIGN PATENT DOCUMENTS

| | | | |
|---|---|---|---|
| JP | 61-192879 | A | 8/1986 |
| JP | 6-39109 | Y2 | 10/1994 |
| JP | 2009-103003 | A | 5/2009 |

OTHER PUBLICATIONS

International Search Report for corresponding Application No. PCT/JP2012/076657, date of mailing Jan. 15, 2013, 2 pages.

* cited by examiner

*Primary Examiner* — Theresa Trieu
(74) *Attorney, Agent, or Firm* — Ditthavong & Steiner, P.C.

(57) ABSTRACT

An internal gear pump includes an inner rotor having n teeth and an outer rotor having (n+1) teeth. A tooth profile of the inner rotor is an envelope of a group of locus circles (13) each having a diameter C and having a center on a trochoidal curve (T), the trochoidal curve being drawn along a locus of a fixation point, which is located distant from a center of a rolling circle (12) by e, when the rolling circle (12) rolls along a base circle (11) without sliding. A tooth profile of the outer rotor is an envelope of a group of tooth-profile curves of a formation inner rotor, the envelope being obtained by first drawing the formation inner rotor in which a diameter of the locus circle (13) is equal to C' determined from expression (C−t), revolving a center ($O_I$) of the formation inner rotor by one lap along a circle (S) having a diameter (2e) and centered on a center ($O_O$) of the outer rotor, and rotating the formation inner rotor 1/n times during the revolution.

1 Claim, 3 Drawing Sheets

INTERNAL GEAR PUMP

TECHNICAL FIELD

The present invention relates to an internal gear pump including an inner rotor whose tooth profile is formed by utilizing a trochoidal curve and an outer rotor whose tooth profile is formed based on an envelope of a locus of a group of tooth-profile curves of the inner rotor. Specifically, the present invention relates to an internal gear pump that prevents management of tooth-profile precision from being difficult even when high volumetric efficiency is required under high discharge pressure.

BACKGROUND ART

An internal gear pump constituted by accommodating a pump rotor, which is formed by combining an inner rotor having n teeth and an outer rotor having (n+1) teeth and eccentrically disposing the rotors relative to each other, within a rotor chamber of a housing is used as, for example, an oil pump for lubricating a vehicle engine or for an automatic transmission (AT).

One example of such an internal gear pump is disclosed in Patent Literature 1 described below.

In the internal gear pump disclosed in Patent Literature 1, a trochoidal curve is first drawn along the locus of a fixation point located distant from the center of a rolling circle, which rolls along a base circle without sliding, by e. Then, an envelope of a group of locus circles each having its center on the trochoidal curve serves as a tooth profile of the inner rotor.

A tooth profile of the outer rotor is formed by using the locus of a group of tooth-profile curves of the inner rotor. Specifically, the center of the inner rotor revolves by one lap along a circle having a diameter of (2e+t) and centered on the center of the outer rotor (e being an amount of eccentricity between the inner rotor and the outer rotor, and t being a tip clearance between the inner rotor and the outer rotor at a theoretical eccentric position) while the inner rotor rotates (1/n) times. An envelope of a group of tooth-profile curves of the inner rotor at that time serves as the tooth profile of the outer rotor.

CITATION LIST

Patent Literature

PTL 1: Japanese Examined Utility Model Registration Application Publication No. 6-39109

SUMMARY OF INVENTION

Technical Problem

In an internal gear pump, if high volumetric efficiency is required under high discharge pressure, the aforementioned tip clearance t needs to be reduced. However, in order to fulfill this demand while preventing a rotation failure of the rotor in the pump having the specifications according to Patent Literature 1, the tooth profiles need to be managed with high precision so as to avoid interference between the teeth of the inner rotor and the outer rotor. As a result, the manufacturing process becomes difficult, thus affecting mass productivity and costs.

An object of the present invention is to provide a tooth-profile formation method that allows for management of tooth-profile precision suitable for a desired tip clearance range even for a pump that requires high volumetric efficiency under high discharge pressure.

Solution to Problem

In order to solve the aforementioned problem, the present invention provides an internal gear pump that includes an inner rotor having n teeth and an outer rotor having (n+1) teeth. A tooth profile of the inner rotor is an envelope of a group of locus circles (13) each having a diameter C and having a center on a trochoidal curve (T), the trochoidal curve being drawn along a locus of a fixation point, which is located distant from a center of a rolling circle (12) by e, when the rolling circle (12) rolls along a base circle (11) without sliding. A tooth profile of the outer rotor is an envelope of a group of tooth-profile curves of a formation inner rotor, the envelope being obtained by first drawing the formation inner rotor in which a diameter of the locus circle (13) is equal to C' determined from expression (C−t), revolving a center ($O_I$) of the formation inner rotor by one lap along a circle (S) having a diameter (2e) and centered on a center ($O_O$) of the outer rotor, and rotating the formation inner rotor 1/n times during the revolution. In this case, e denotes an amount of eccentricity between the inner rotor and the outer rotor, and t denotes a tip clearance between the inner rotor and the outer rotor.

The locus-circle diameter C in this case is determined by the following method. Specifically, a large diameter of the outer rotor, a small diameter of the inner rotor, and a pump discharge rate are first set on the basis of required specifications.

Then, a diameter A of the base circle 11 necessary for satisfying the required specifications is determined from the large diameter of the outer rotor and the small diameter of the inner rotor. Moreover, the number n of teeth of the inner rotor necessary for satisfying the required pump discharge rate and an amount of eccentricity e between the inner rotor and the outer rotor are determined.

A diameter B of the rolling circle is equal to A/n. Furthermore, if the radius (C/2) of the rolling circle is smaller than a radius of curvature ρ of the trochoidal curve T drawn as the result of the rolling circle being rolled along the base circle, an inner rotor having smooth tooth surfaces is obtained. The locus-circle diameter C is determined by selecting numeral values that satisfy the required specifications.

Because the rolling-circle diameter B and the locus-circle diameter C affect the tooth profile of the inner rotor, numerical values that are not excess or deficient and by which an appropriate shape can be ensured are selected while taking into consideration, for example, past data.

Advantageous Effects of Invention

In a related-art product in which a tip clearance is ensured by revolving the center of an inner rotor along a circle having a diameter of (2e+t) when the tooth profile of an outer rotor is to be drawn based on an envelope of a group of tooth-profile curves of the inner rotor, the gap between teeth is small near a meshing section where the teeth of the inner rotor and the outer rotor mesh with each other due to the effect of t added to the diameter of the circle along which the center of the inner rotor is revolved. The gap between the teeth becomes larger toward a tip clearance section formed between the inner rotor and the outer rotor.

As the gap between the teeth varies more and more, interference between tooth tips, that is, a rotation failure, tends to occur more readily. As a countermeasure for avoiding such interference, tooth-profile precision needs to be strictly managed.

In the present invention, the inner rotor whose locus-circle diameter is equal to C' (=C−t) is used for forming the tooth profile of the outer rotor so that a desired tip clearance t is ensured. Therefore, when drawing the tooth profile of the outer rotor, it is not necessary to add the value oft to the circle along which the center of the inner rotor is revolved.

The inner rotor used for forming the outer rotor is rotated while the inner rotor is revolved along the circle that is concentric with the center of the outer rotor having a diameter of 2e, so that an envelope is drawn. The envelope serves as the tooth profile of the outer rotor. Accordingly, since the effect oft occurring in the related-art product is eliminated, the gap between the teeth does not vary from the meshing section toward the tip clearance section.

Accordingly, if the tooth-profile precision is the same between the inner rotor and the outer rotor, interference between tooth tips is less likely to occur in the present invention than in the related-art product. Therefore, the tooth-profile precision can be managed more readily during the rotor manufacturing process as compared with the related-art product.

DESCRIPTION OF EMBODIMENT

An embodiment of an internal gear pump according to the present invention will be described below with reference to FIGS. 1 to 3.

Figure 1:
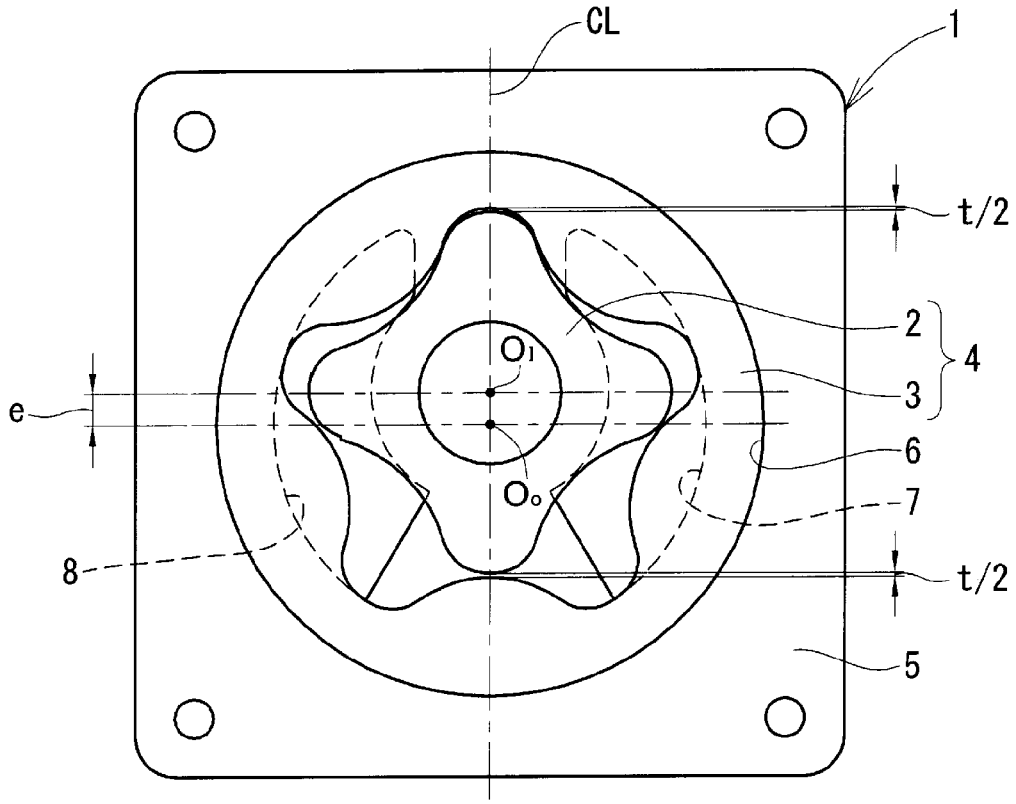
FIG. 1 is an end-surface diagram illustrating an example of an internal gear pump according to the present invention, showing a state where a cover is removed from a housing.

In an internal gear pump 1 shown in FIG. 1, a pump rotor 4 is formed by combining an inner rotor 2 having n teeth and an outer rotor 3 having (n+1) teeth and eccentrically disposing the rotors relative to each other. The pump rotor 4 is accommodated within a rotor chamber 6 in a housing 5. Reference character $O_I$ denotes the center of the inner rotor, reference character $O_O$ denotes the center of the outer rotor, and reference character e denotes an amount of eccentricity between the inner rotor 2 and the outer rotor 3. An intake port 7 and a discharge port 8 are formed in an end surface of the rotor chamber 6.

Figure 2:
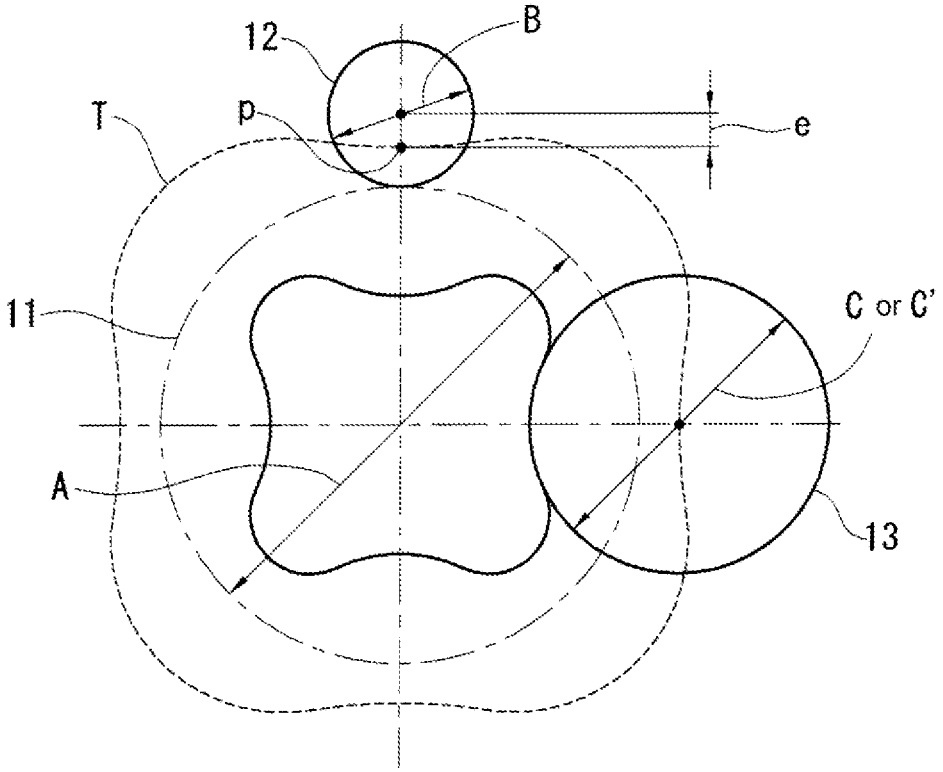
FIG. 2 illustrates a method for forming a tooth profile of an inner rotor in the internal gear pump according to the present invention.

The inner rotor 2 of the internal gear pump 1 shown in FIG. 1 is formed based on a method shown in FIG. 2, that is, by using a base circle 11 having a diameter A, a rolling circle 12 having a diameter B, and a locus circle 13 having a diameter C.

In FIG. 1, when the outer rotor is fixed and the inner rotor is moved into contact with the outer rotor in an upward direction of an eccentric axis CL (i.e., upward direction in the drawing), a tip clearance t corresponds to a gap formed between the teeth of the inner rotor and the outer rotor along the eccentric axis CL at an opposite side of the contact point (i.e., the opposite side of the contact point, which is across the rotor center).

In detail, a trochoidal curve T is drawn along the locus of a fixation point p located distant from the center of the rolling circle 12, which rolls along the base circle 11 without sliding, by e. Then, the center of the locus circle 13 is placed on the trochoidal curve T, and the locus circle 13 is moved along the trochoidal curve T. An envelope of a group of locus circles 13 obtained in this manner serves as a tooth profile.

As mentioned above, a large diameter of the outer rotor and a small diameter of the inner rotor are set from limitations based on a user's demand, and the diameter A of the base circle 11 is subsequently determined based on the set values. Furthermore, the number n of teeth of the inner rotor 2 that satisfies the required specifications for the pump discharge rate and the amount of eccentricity e between the inner rotor 2 and the outer rotor 3 are determined.

Moreover, the diameter B of the rolling circle 12 is determined based on the relationship between the base-circle diameter A and the number n of teeth (B=A/n). The locus-circle diameter C of the locus circle 13 is determined from the relationship ($C/2<\rho$) it has with a radius of curvature ρ of the trochoidal curve T drawn along the locus of the fixation point of the rolling circle 12.

A locus circle 13 having a diameter C' obtained from expression (C−t) is used, and the center of the locus circle 13 is positioned on the aforementioned trochoidal curve T, so that an envelope of a group of locus circles serves as an inner-rotor tooth profile used for forming the outer rotor.

Since this tooth profile uses the locus circle 13 having the diameter C' that is smaller than the diameter C, the formation-inner-rotor tooth profile drawn based on the envelope of the group of locus circles 13 is larger than that of the inner rotor 2 that uses a locus circle having the diameter C.

Figure 3:
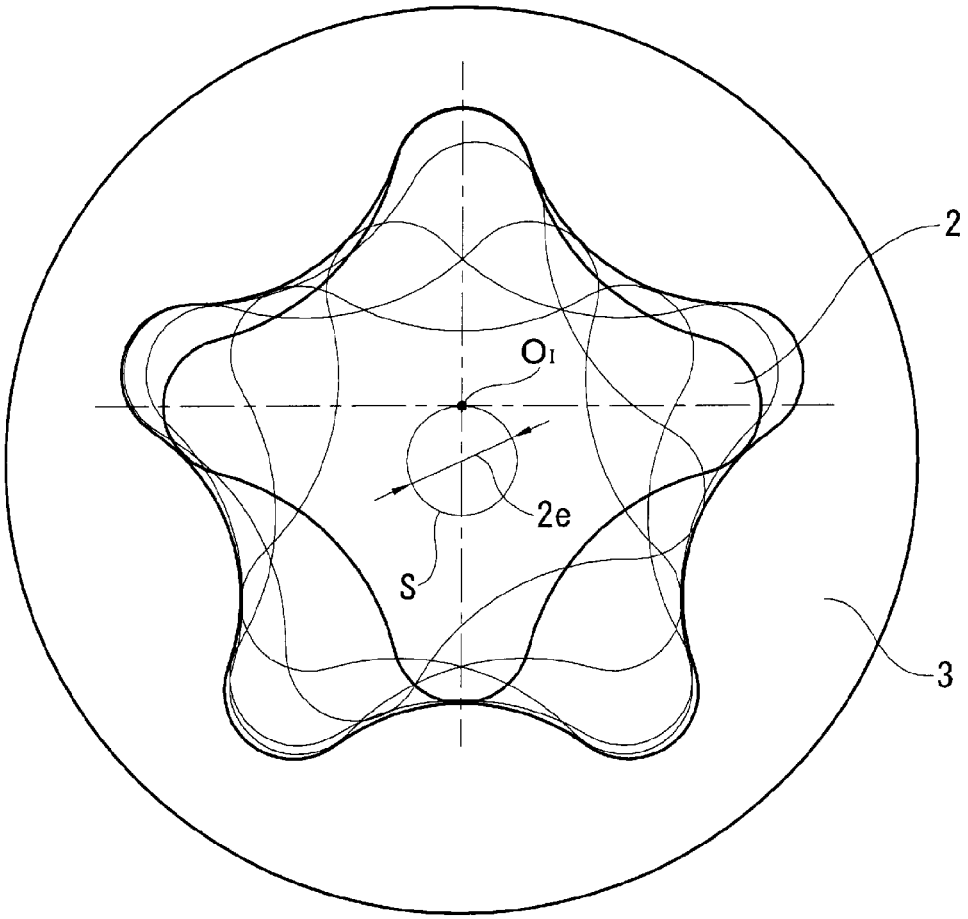
FIG. 3 illustrates a method for forming a tooth profile of an outer rotor in the internal gear pump according to the present invention.

Next, referring to FIG. 3, the center $O_I$ of the obtained formation inner rotor is placed on a circle S that is concentric with the center of an outer rotor having a diameter of 2e. While revolving the center $O_I$ of the formation inner rotor along the circle S, the inner rotor is rotated (1/n) times per one revolution. An envelope of a group of tooth profile curves of the formation inner rotor obtained in this manner serves as a tooth profile for the outer rotor.

With the above-described method, a desired tip clearance t can be produced between the inner rotor 2 and the outer rotor 3, as in the related-art product.

Furthermore, this method eliminates the effect oft on the diameter of the circle along which the center of the inner rotor is revolved when forming the tooth profile for the outer rotor, which was seen in the related art, so that the gap between the teeth is made constant from a meshing section to a tip clearance section. Therefore, interference between the tooth tips of the inner rotor and the outer rotor is less likely to occur, as compared with the related-art product, thereby facilitating management of tooth-profile precision during the rotor manufacturing process, as compared with the related-art product.

EXAMPLE 1

An inner rotor having six teeth and whose tooth profile is formed based on the method shown in FIG. 2 by using a base circle 11 having a diameter A of 42 mm, a rolling circle 12 having a diameter B of 7 mm, and a locus circle 13 having a diameter C of 14 mm is obtained.

By rotating the inner rotor, whose locus circle has a diameter of C' of 13.94 mm, while revolving the center of the inner rotor along a circle that is concentric with the center of an outer rotor having a diameter of 2e, an outer rotor having seven teeth and whose tooth profile is formed based on the method shown in FIG. 3 is obtained. The inner rotor and the outer rotor are combined with each other with an amount of eccentricity e of 2.8 mm therebetween, whereby a pump rotor is fabricated. The pump rotor is fitted into a housing, whereby an internal gear pump with a theoretical discharge rate of 6 $cm^3$/rev is obtained. The tip clearance t ranges between 0.02 mm and 0.10 mm inclusive, and a median value thereof is designed to be 0.06 mm.

Dimensional specifications of the rotors in this internal gear pump are as follows:

Large Diameter of Outer Rotor: 46.26 mm

Small Diameter of Inner Rotor: 29.4 mm

Amount of Eccentricity e: 2.8 mm

In the case where the tip clearance t is set between 0.02 mm and 0.10 mm inclusive for this sample product, the tooth-profile precision of the inner rotor and the outer rotor needs to be managed theoretically within a tolerance range of 0.020 mm.

In order to fulfill this demand with the pump having the tooth profile designed based on the related-art method disclosed in Patent Literature 1, the tooth-profile precision of the inner rotor and the outer rotor needs to be managed within a tolerance range of 0.016 mm so that the demand can be fulfilled without causing the teeth of the inner rotor and the outer rotor to interfere with each other.

In contrast, in the pump according to the present invention, the target tip clearance can be achieved without causing the teeth to interfere with each other by managing the tooth-profile precision of the inner rotor and the outer rotor within the theoretical tolerance range of 0.020 mm.

REFERENCE SIGNS LIST

1 internal gear pump
2 inner rotor
3 outer rotor
4 pump rotor
5 housing
6 rotor chamber
7 intake port
8 discharge port
$O_I$ center of inner rotor
$O_O$ center of outer rotor
11 base circle
12 rolling circle
13 locus circle
p fixation point of rolling circle by which trochoidal curve is drawn
A base-circle diameter
B rolling-circle diameter
C locus-circle diameter
C' locus-circle diameter of inner rotor used for forming outer rotor
T trochoidal curve
S circle along which center of inner rotor is revolved during outer-rotor tooth-profile forming process
CL eccentric axis

The invention claimed is:

1. An internal gear pump comprising an inner rotor having n teeth and an outer rotor having (n+1) teeth, wherein a tooth profile of the inner rotor is an envelope of a group of locus circles (13) each having a diameter C and having a center on a trochoidal curve (T), the trochoidal curve being drawn along a locus of a fixation point, which is located distant from a center of a rolling circle (12) by e, when the rolling circle (12) rolls along a base circle (11) without sliding, and wherein a tooth profile of the outer rotor is an envelope of a group of tooth-profile curves of a formation inner rotor, the envelope being obtained by first drawing the formation inner rotor in which a diameter of the locus circle (13) is equal to C' determined from expression (C−t), revolving a center ($O_I$) of the formation inner rotor by one lap along a circle (S) having a diameter (2e) and centered on a center ($O_O$) of the outer rotor, and rotating the formation inner rotor 1/n times during the revolution, where e denotes an amount of eccentricity between the inner rotor and the outer rotor, and t denotes a tip clearance between the inner rotor and the outer rotor.

* * * * *